US012084950B2

(12) United States Patent
Cui et al.

(10) Patent No.: US 12,084,950 B2
(45) Date of Patent: Sep. 10, 2024

(54) HEAVY OIL LIFTING DEVICE AND HEAVY OIL LIFTING METHOD

(71) Applicant: YANTAI JEREH PETROLEUM EQUIPMENT & TECHNOLOGIES CO., LTD., Shandong (CN)

(72) Inventors: Qili Cui, Shandong (CN); Xueyang Zhao, Shandong (CN); Lin Jiang, Shandong (CN); Bo Ding, Shandong (CN); Qingren Lin, Shandong (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 74 days.

(21) Appl. No.: 17/854,714

(22) Filed: Jun. 30, 2022

(65) Prior Publication Data

US 2022/0412196 A1 Dec. 29, 2022

(30) Foreign Application Priority Data

Jun. 28, 2021 (CN) ..... 202110717853.7

(51) Int. Cl.
*E21B 43/12* (2006.01)
*E21B 36/00* (2006.01)
*E21B 43/40* (2006.01)

(52) U.S. Cl.
CPC ..... *E21B 43/129* (2013.01); *E21B 36/006* (2013.01); *E21B 43/40* (2013.01)

(58) Field of Classification Search
CPC ..... E21B 43/129; E21B 43/40; E21B 36/006; E21B 43/121; E21B 43/126
See application file for complete search history.

(56) References Cited

U.S. PATENT DOCUMENTS

2020/0088009 A1* 3/2020 Cui ..... F04B 49/22

FOREIGN PATENT DOCUMENTS

| | | | | | |
|---|---|---|---|---|---|
| CA | 2255603 | C | * | 2/2001 | ..... F04B 47/04 |
| CN | 201180635 | Y | | 1/2009 | |
| CN | 203905919 | U | | 10/2014 | |
| CN | 104278977 | A | | 1/2015 | |
| CN | 104405630 | A | | 3/2015 | |
| CN | 106014347 | A | | 10/2016 | |
| CN | 112267853 | A | | 1/2021 | |
| CN | 113236191 | A | | 8/2021 | |

* cited by examiner

*Primary Examiner* — Zakiya W Bates
(74) *Attorney, Agent, or Firm* — Crowell & Moring LLP

(57) ABSTRACT

A heavy oil lifting device and a heavy oil lifting method are disclosed. The device includes: a plurality of liquid injection pumps each including a liquid inlet and a liquid outlet and configured to intake in liquid and discharge the liquid after pressurization; a control valve including a first end and a second end, the liquid outlets of the plurality of liquid injection pumps are connected with the first end; a power liquid transmission pipe connected with the second end and configured to transmit the liquid after pressurization; an operation pump connected with the power liquid transmission pipe, and the liquid after pressurization is used as power liquid to drive the operation pump to reciprocate; the control valve is in switchable communication with the liquid injection pump so that the power liquid transmission pipe is in switchable communication with the liquid injection pump.

20 Claims, 10 Drawing Sheets

HEAVY OIL LIFTING DEVICE AND HEAVY OIL LIFTING METHOD

CROSS-REFERENCE OF RELATED APPLICATION

The present application claims priority of China Patent application No. 202110717853.7 filed on Jun. 28, 2021, the content of which is herein incorporated in its entirety as portion of the present application by reference.

TECHNICAL FIELD

At least one embodiment of the present disclosure relates to a heavy oil lifting device and a heavy oil lifting method.

BACKGROUND

In the process of heavy oil lifting from an oil well, with the continuous decrease of oil temperature and air temperature, the viscosity of heavy oil would rise sharply and the heavy oil would gradually harden, just like asphalt on highway.

Usually, viscosity reduction measures should be taken in the process of heavy oil lifting to facilitate the smooth recovery of heavy oil. Heavy oil recovery needs two systems, one of which includes a mechanical system for lifting crude oil, and the other of which includes a viscosity reducing system for reducing the viscosity of the crude oil during lifting. The mechanical system is classified into two types: a rod pump system and a rod-less pump system. Usually, the rod pump system includes a beam pumping unit or a screw pump; whereas the rod-less pump system includes a hydraulic pump or an electric submersible centrifugal pump. The main ways of heavy oil lifting and oil viscosity reduction include thermal viscosity reduction and chemical viscosity reduction. The Liaohe Oilfield, for example, uses the electric heating rod for thermal viscosity reduction, which cooperates with the beam pumping unit to lift the heavy oil, while the Xinjiang Oilfield, for another example, uses the method of mixing with thin oil to reduce viscosity, which cooperates with the screw pump to lift the heavy oil. Both operation schemes are costly. Therefore, a heavy oil lifting technology that can reduce both the costs and the construction operations is required.

SUMMARY

At least one embodiment of the present disclosure relates to a heavy oil lifting device and a heavy oil lifting method.

At least one embodiment of the present disclosure relates to a heavy oil lifting device, including: a plurality of liquid injection pumps, each of the plurality of liquid injection pumps including a liquid inlet and a liquid outlet, and each of the plurality of liquid injection pumps being configured to suck in liquid and discharge the liquid after pressurization; a control valve, including a first end and a second end, the liquid outlets of the plurality of liquid injection pumps being connected with the first end of the control valve; a power liquid transmission pipe, connected with the second end of the control valve so as to be configured to transmit the liquid after pressurization; an operation pump, connected with the power liquid transmission pipe, and the liquid after pressurization being used as power liquid to drive the operation pump to reciprocate; the control valve is configured to be in switchable communication with one of the plurality of liquid injection pumps so that the power liquid transmission pipe is in switchable communication with one of the plurality of liquid injection pumps.

For example, the plurality of liquid injection pumps include at least two liquid injection pumps with different powers.

For example, the heavy oil lifting device further includes a tubing, the power liquid transmission pipe is located in the tubing, and the operation pump is located in the tubing.

For example, the power liquid drives the operation pump to reciprocate and then generates spent liquid, and the spent liquid is mixed with well liquid to form an oil-containing mixed liquid, and the operation pump is configured to lift the oil-containing mixed liquid to the ground through the tubing.

For example, the heavy oil lifting device further includes a first transmission pipeline, the first transmission pipeline is connected with the liquid inlets of the plurality of liquid injection pumps, and the first transmission pipeline is configured to transmit the liquid.

For example, the heavy oil lifting device further includes a filter, the filter is arranged in the first transmission pipeline and configured to filter the liquid passing through the filter.

For example, the heavy oil lifting device further includes a second transmission pipeline, the liquid outlets of the plurality of liquid injection pumps are connected with the power liquid transmission pipe through the second transmission pipeline.

For example, the heavy oil lifting device further includes a flowmeter, the flowmeter is arranged in the second transmission pipeline.

For example, the heavy oil lifting device further includes a third transmission pipeline, the third transmission pipeline is connected with the tubing to transmit the oil-containing mixed liquid.

For example, the heavy oil lifting device further includes a separator, the separator is connected with the third transmission pipeline, the separator is configured to perform oil-water separation on the oil-containing mixed liquid, the separator includes an oil outlet and a water outlet, and the water outlet is connected with the first transmission pipeline to form a circulation loop of the power liquid.

For example, the heavy oil lifting device further includes a heating member, the heating member is configured to heat the liquid to form thermal power liquid.

For example, the heavy oil lifting device further includes a casing, the tubing is located in the casing.

For example, the heavy oil lifting device further includes a control member, the control member is connected with the control valve to be configured to control the control valve to communicate with one of the plurality of liquid injection pumps.

For example, the operation pump includes a housing, a piston structure and a partition member, the partition member divides the housing into a first chamber and a second chamber, and the piston structure includes a piston rod, a first piston and a second piston, and the first piston and the second piston are respectively arranged at two ends of the piston rod, the first piston is located in the first chamber and divides the first chamber into a first power liquid chamber and a first oil chamber, and the second piston is located in the second chamber and divides the second chamber into a second power liquid chamber and a second oil chamber, the piston rod passes through the partition member, and the piston structure can rotate around an axis of the piston rod.

At least one embodiment of the present disclosure further provides a heavy oil lifting method, including: sucking in liquid by a liquid injection pump, and pressurizing and discharging the liquid; taking the liquid after pressurization as power liquid; passing the power liquid through a power liquid transmission pipe to drive an operation pump to perform a reciprocating motion; mixing spent liquid that is generated from the power liquid with well liquid in a pump chamber of the operation pump to form oil-containing mixed liquid; and lifting the oil-containing mixed liquid to the ground through the reciprocating motion of the operation pump. A plurality of liquid injection pumps is arranged, each of the plurality of liquid injection pumps includes a liquid inlet and a liquid outlet, the liquid outlets of the plurality of liquid injection pumps are connected with a control valve, the method further includes: adjusting the control valve to be in switchable communication with one of the plurality of liquid injection pumps so that the power liquid transmission pipe is in switchable communication with one of the plurality of liquid injection pumps.

For example, the plurality of liquid injection pumps include at least two liquid injection pumps with different powers, and the method further includes: selecting a liquid injection pump with a suitable power for operation according to an operation parameter.

For example, the heavy oil lifting method further includes: performing oil-water separation on the oil-containing mixed liquid lifted to the ground. Separated water is sucked into the liquid injection pump to be used as the liquid so as to form a circulation loop of the power liquid.

For example, the heavy oil lifting method further includes: heating the power liquid to form a thermal power liquid.

BRIEF DESCRIPTION OF THE DRAWINGS

In order to clearly illustrate the technical solutions of the embodiments of the present disclosure, the drawings of the embodiments will be briefly described in the following; it is obvious that the described drawings below are only related to some embodiments of the present disclosure without construing any limitation thereto.

DETAILED DESCRIPTION

Figure 1:
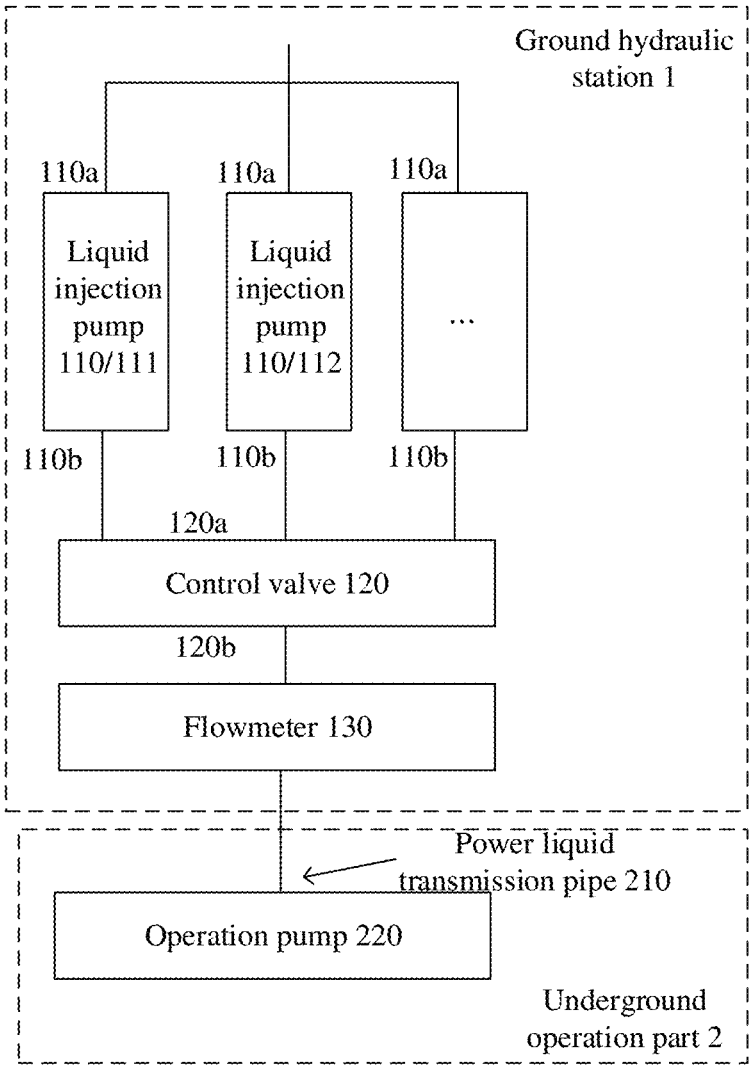
FIG. 1 is a schematic diagram of an example heavy oil lifting device provided by an embodiment of the present disclosure.

In order to explain the objects, technical details and advantages of the embodiments of the disclosure, the technical solutions of the embodiments are described in connection with the drawings related to the embodiments of the disclosure. The described embodiments are merely examples. Based on the described embodiments herein, those having ordinary skill in the art can obtain other embodiment(s), without any inventive work, which should be considered within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Conventional heavy oil lifting devices have at least one of the following problems.

I. A single plunger pump is used in the hydraulic station of the heavy oil lifting device, and the parameters such as the power of the plunger pump cannot be adjusted under different circumstances. If the plunger pump fails, the heavy oil lifting operation will be affected.

II. High cost.

The conventional heavy oil lifting technology, whether it is electric heating, mixing with thin oil or chemical viscosity reduction, is costly and brings economic burden to heavy oil recovery.

III. Significant mechanical wear and risk of sand plugging.

For sand-bearing oil wells, the commonly used oil recovery machine adopted in the conventional technical scheme is prone to cause sand plugging (or blocking) or sand sticking, which will result in equipment shutdown and even safety accidents. At the same time, the equipment adopting rod pumps may cause eccentric wear, while the equipment adopting rod-less oil recovery machine will have complex structure with poor operation efficiency, which will affect the recovery yields.

IV. Poor applicability and low efficiency.

Conventional beam pumping units are not suitable for horizontal wells and compound wells. However, horizontal wells and compound wells are the development trend of heavy oil recovery technology in the future and can greatly improve the recovery ratio of heavy oil wells.

The heavy oil lifting device provided by at least one embodiment of the present disclosure can solve at least one of the above problems.

Figure 2:
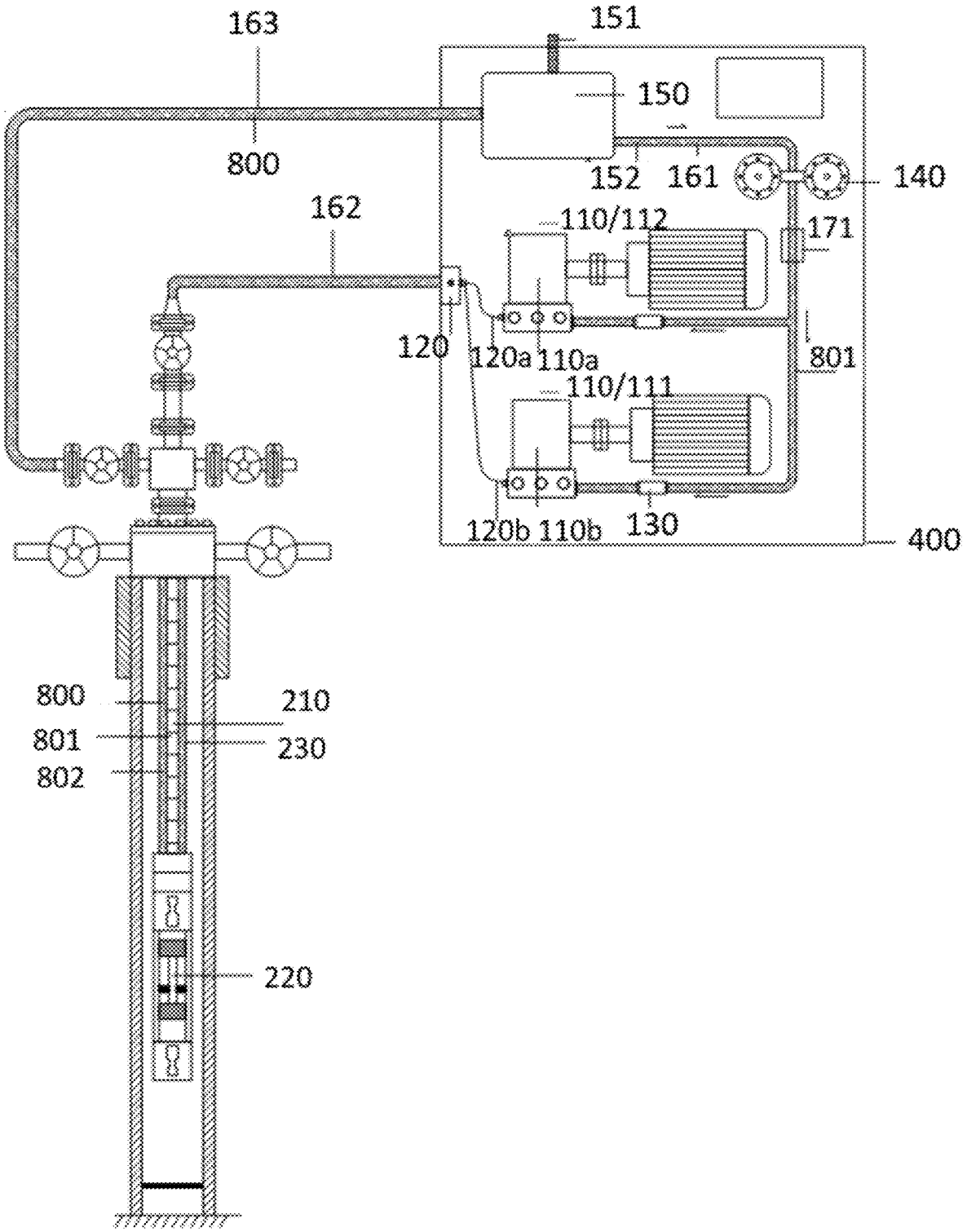
FIG. 2 is a schematic diagram of an example heavy oil lifting device provided by an embodiment of the present disclosure.
Figure 3:
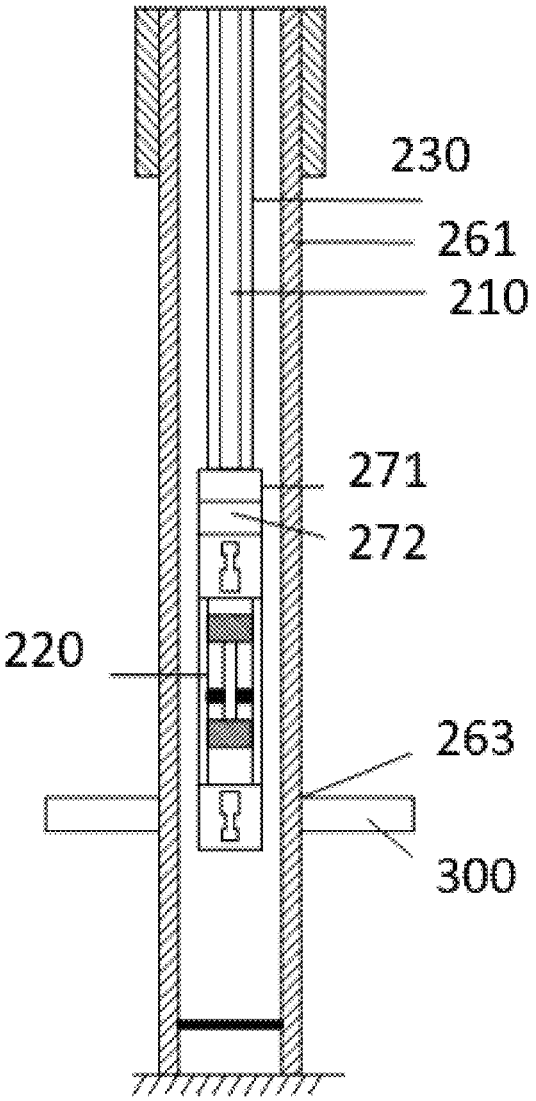
FIG. 3 is a schematic diagram of an underground operation part of an example heavy oil lifting device provided by an embodiment of the present disclosure.
Figure 4A:
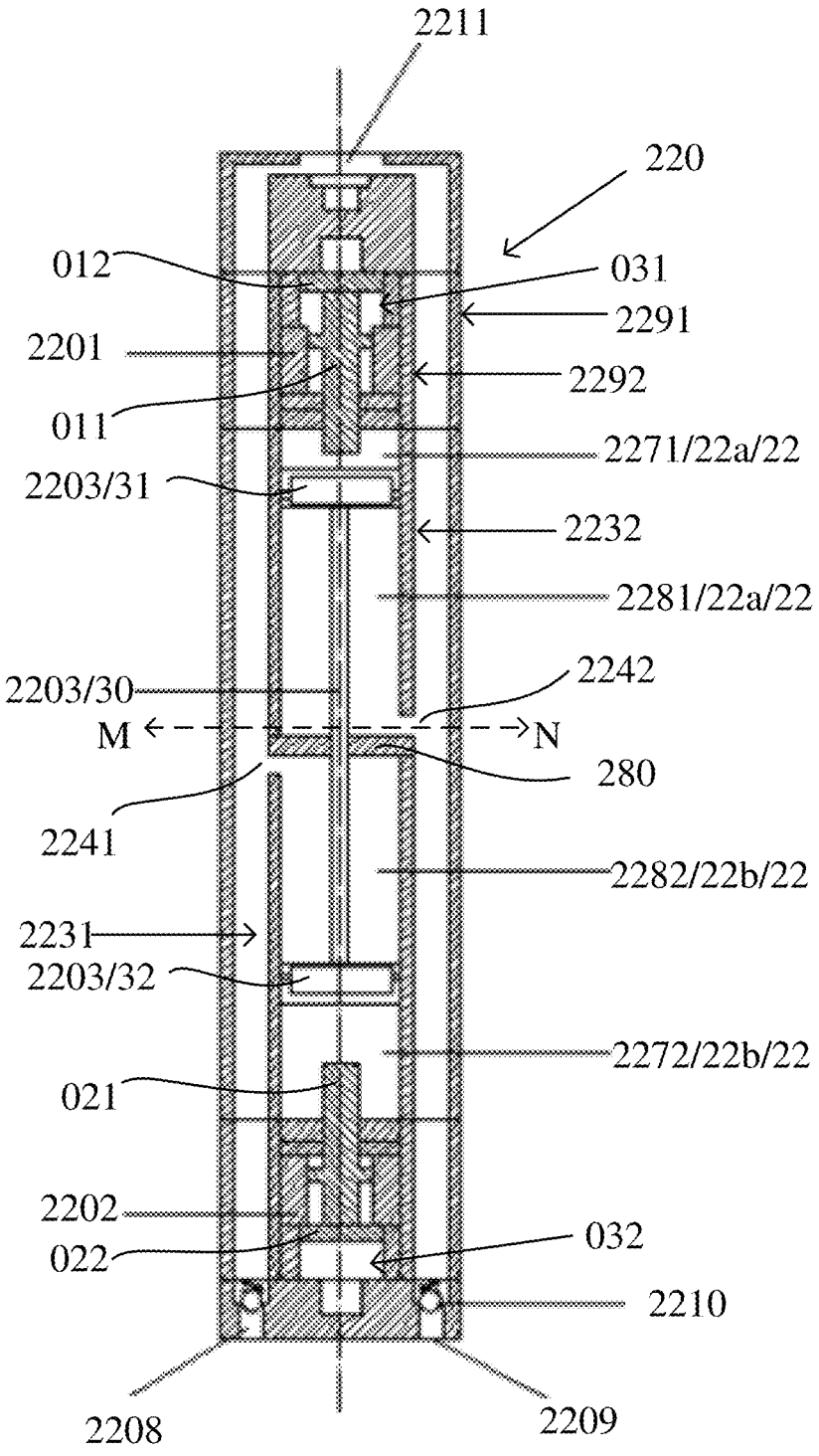
FIG. 4A is a schematic sectional view of two oil pumping pipeline of an operation pump in an example heavy oil lifting device provided by an embodiment of the present disclosure.
Figure 4B:
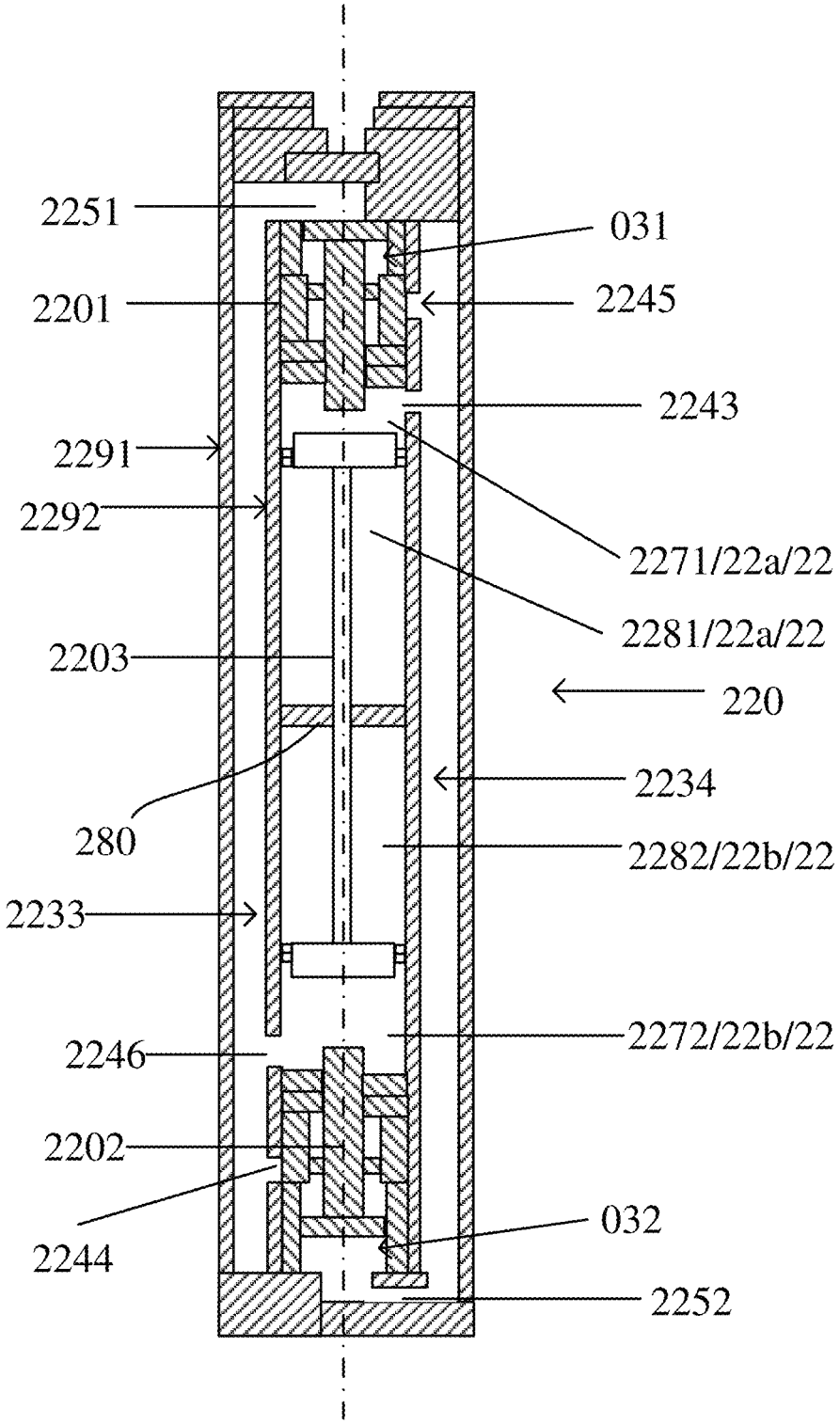
FIG. 4B is a schematic sectional view of two reversing pipelines of an operation pump in an example heavy oil lifting device according to an embodiment of the present disclosure.
Figure 4C:
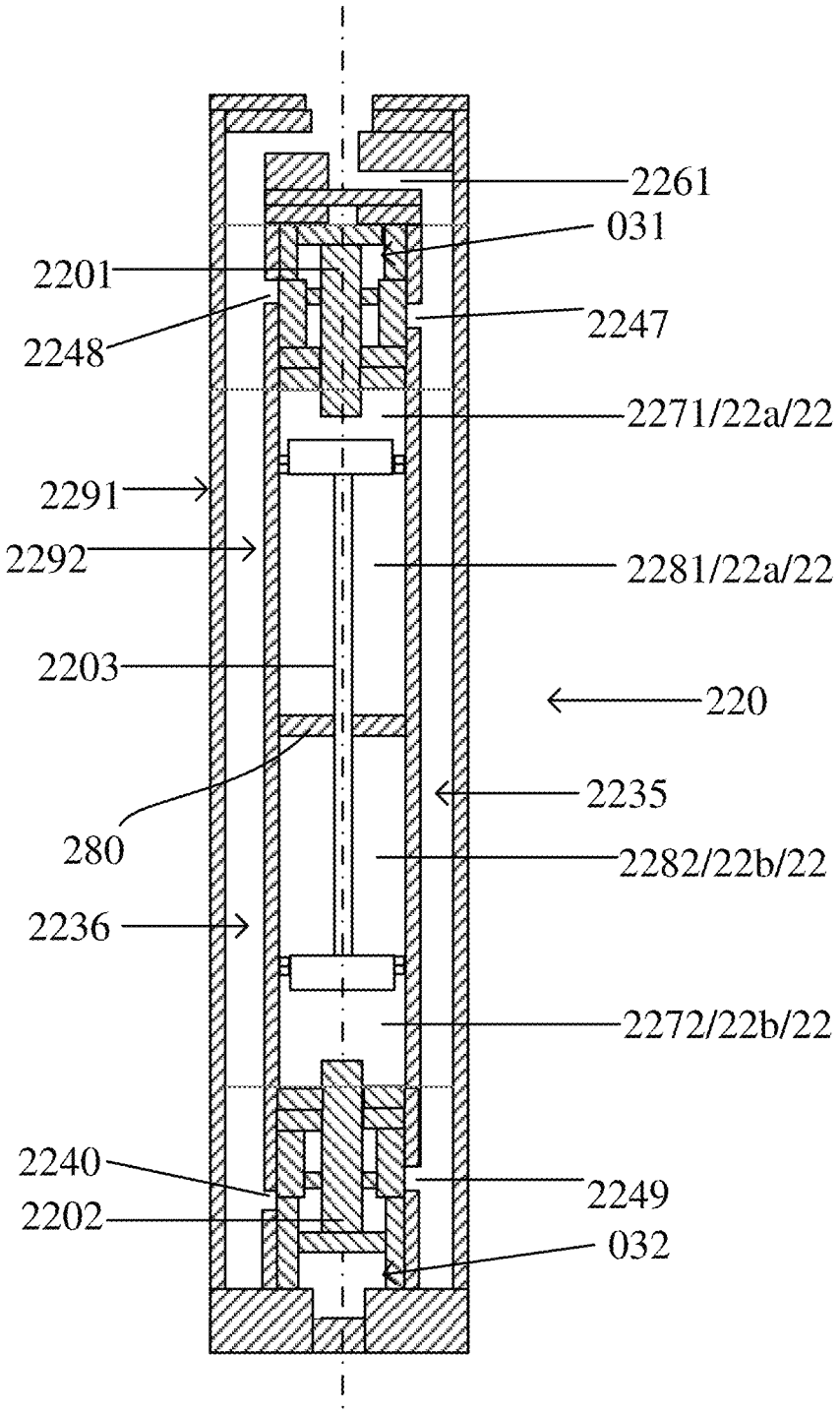
FIG. 4C is a schematic sectional view of two power liquid pipelines of an operation pump in an example heavy oil lifting device according to an embodiment of the present disclosure.
Figure 4D:
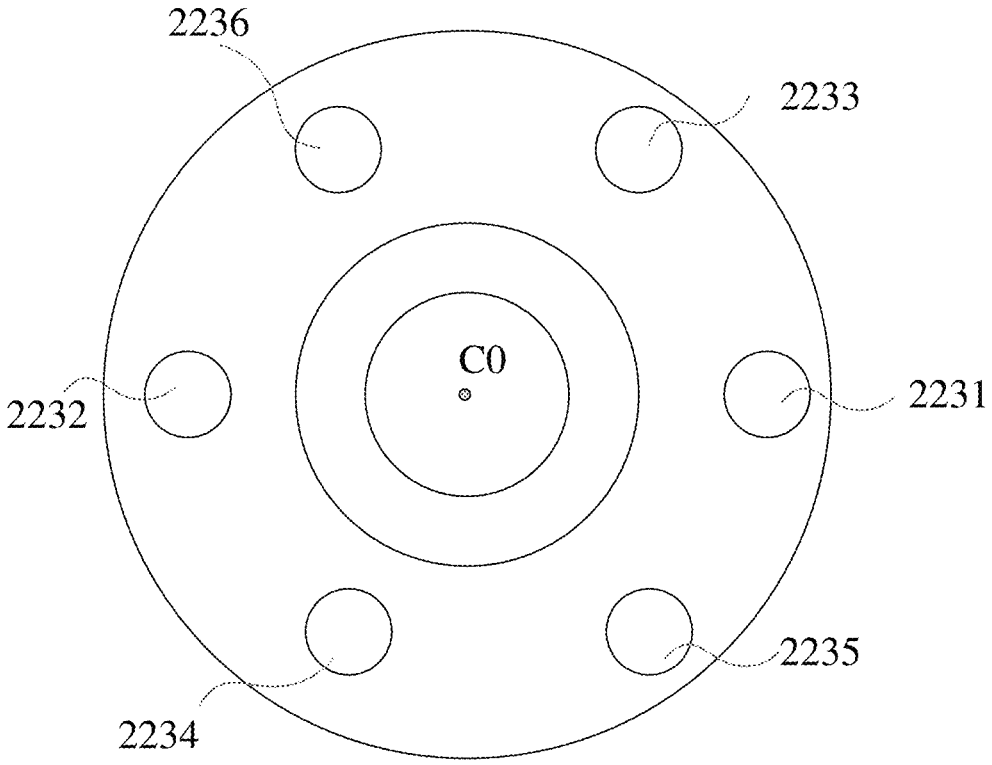
FIG. 4D is a schematic sectional view along line M-N of FIG. 4A.
Figure 5:
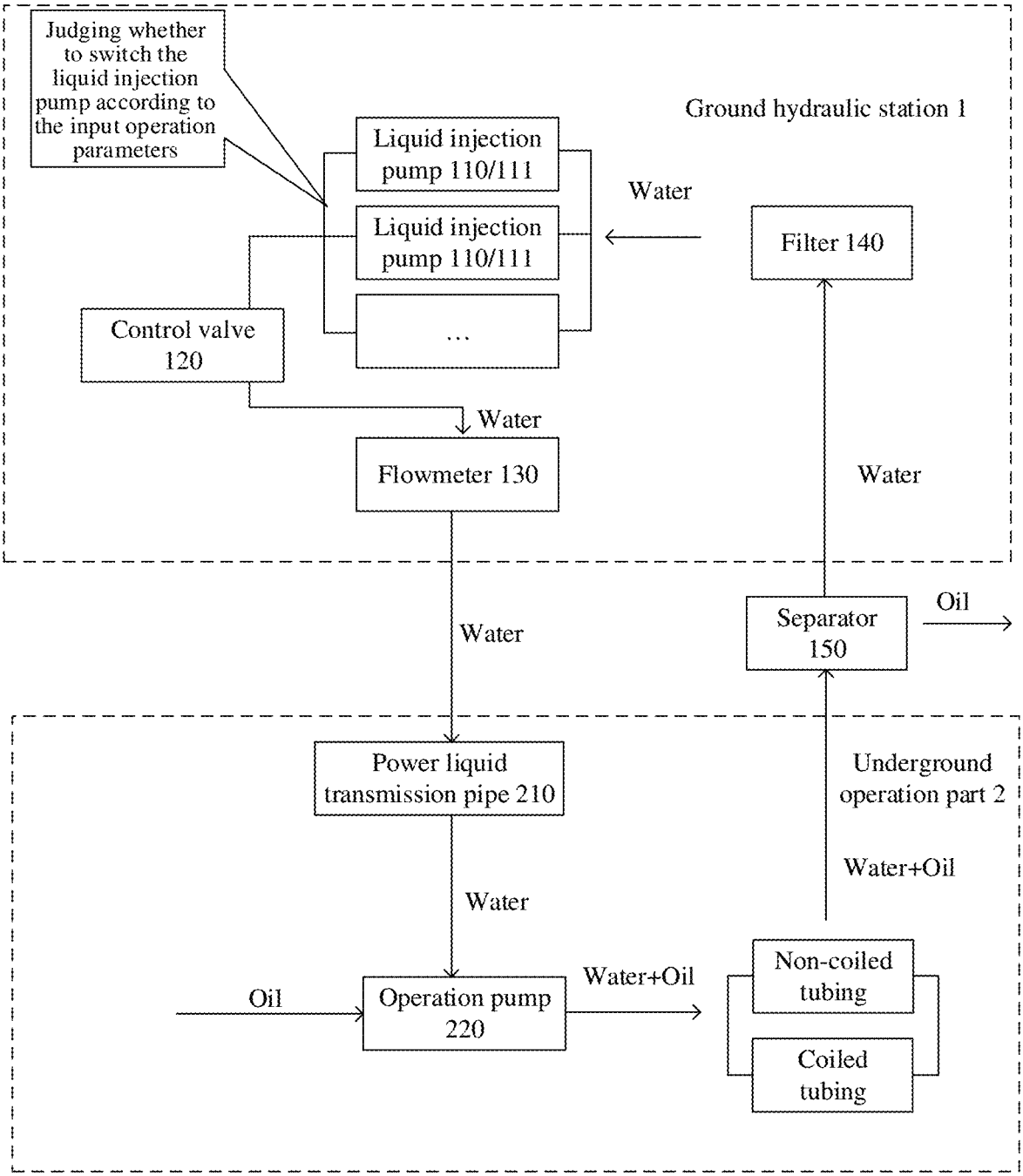
FIG. 5 is a schematic diagram of an example heavy oil lifting device or method provided by an embodiment of the present disclosure.

FIG. 1 is a schematic diagram of a heavy oil lifting device provided by an example embodiment of the present disclosure. FIG. 2 is a schematic diagram of a heavy oil lifting device provided by an embodiment of the present disclosure. FIG. 3 is a schematic diagram of an underground operation part of a heavy oil lifting device provided by an embodiment of the present disclosure. FIG. 4A is a schematic sectional view of two oil pumping pipeline of an operation pump in a heavy oil lifting device provided by an embodiment of the present disclosure. FIG. 4B is a schematic sectional view of two reversing pipelines of an operation pump in a heavy oil lifting device according to an embodiment of the present disclosure. FIG. 4C is a schematic sectional view of two power liquid pipelines of an operation pump in a heavy oil lifting device according to an embodiment of the present disclosure. FIG. 4D is a schematic sectional view along line M-N of FIG. 4A. FIG. 5 is a schematic diagram of a heavy oil lifting device or method provided by an embodiment of the present disclosure. Hereinafter, the heavy oil lifting device and the heavy oil lifting method provided by the embodiments of the present disclosure will be described with reference to FIGS. 1 to 5.

As illustrated in FIG. 1, FIG. 2 and FIG. 5, the heavy oil lifting device includes a ground hydraulic station 1 and an underground operation part 2. The ground hydraulic station 1 includes a plurality of liquid injection pumps 110 and a control valve 120; the underground operation part 2 includes a power liquid transmission pipe 210 and an operation pump 220. As illustrated in FIG. 1, each liquid injection pump 110 includes a liquid inlet 110*a* and a liquid outlet 110*b*, and the liquid injection pump 110 is configured to intake liquid and discharge the liquid after pressurization. The term intake may be alternatively referred to as "intake" or draw". Liquid outlets 110*b* of the plurality of liquid injection pumps 110 are connected with a first end 120*a* of the control valve 120; that is, the liquid outlets 110*b* of the liquid injection pumps 110 are commonly connected to the first end 120*a* of the control valve 120, and a second end 120*b* of the control valve 120 is connected to the power liquid transmission pipe 210, the power liquid transmission pipe 210 is configured to transmit the liquid after pressurization. The power liquid transmission pipe 210 is connected with the operation pump 220, and the liquid after pressurization is used as power liquid to drive the operation pump 220 to reciprocate. For example, the liquid injection pump 110 is connected to the operation pump 220 through the power liquid transmission pipe 210. For example, the operation pump 220 is a downhole operation pump. For example, the power liquid includes water.

As illustrated in FIG. 1, FIG. 2, and FIG. 5, the control valve 120 is configured to switchably communicate with one of the plurality of liquid injection pumps 110 so that the power liquid transmission pipe 210 is switchably communicated with one of the plurality of liquid injection pumps 110.

The heavy oil lifting device provided by the embodiment of the present disclosure is suitable for heavy oil recovery operations and can be used for heavy oil lifting procedures.

Unlike the hydraulic station of conventional heavy oil lifting device in which only a single liquid injection pump is provided, the heavy oil lifting device provided by the embodiment of the present disclosure is provided with a plurality of liquid injection pumps which can be switched for use. The lifting device has a simple structure, in which a suitable liquid injection pump among the plurality of liquid injection pumps can be switched for use through the control valve 120, and the remaining liquid injection pumps can be used as standby. Thus, it enhances the service life and cycle of the equipment, improves stability and maintenance convenience, saves maintenance time, and allows for stably operation.

For example, the liquid injection pump 110 is configured to suck in low-pressure liquid and pressurize the low-pressure liquid to form high-pressure liquid. The pressure of the high-pressure liquid is greater than the pressure of the low-pressure liquid. The low-pressure liquid can also be referred to as sucked-in liquid, and the high-pressure liquid can also be referred to as discharged liquid. The low-pressure liquid can be referred to as a first pressure liquid. The high-pressure liquid can be referred to as a second pressure liquid. For example, the liquid injection pump 110 is configured to suck in the first pressure liquid and to discharge the second pressure liquid, and the second pressure is greater than the first pressure.

For example, the plurality of liquid injection pumps 110 include at least two liquid injection pumps 110 with different powers. For example, a plurality of liquid injection pumps can have different powers, different model numbers, different structures, etc., so that the liquid injection pumps with different specifications can be switched, and the diversity of choices can be improved. Choosing different power injection pumps for use in a switchable way can meet the needs of downhole operations in different periods and provide more control options for heavy oil recovery operations.

For example, the liquid injection pump can adopt three cylinders or five cylinders, can be equipped with a plurality of liquid injection pumps with different power performances, automatically judge and select the liquid injection pump suitable for operation by inputting operation parameters, and control the injection flow rate of the power liquid to adjust the volume of production liquid of the wells. In some examples, there may be a plurality of liquid injection pumps, one of which can be operated and the remaining ones can be in standby mode, which is convenient for maintenance.

For example, the control valve 120 includes an electric control valve (but not limited to electric), and an appropriate control valve can be selected according to its intended function. For example, in some embodiments, the control valve 120 includes a valve body and a valve core. For example, in some embodiments, the first end 120*a* of the control valve 120 communicates with the selected liquid injection pump 110 through the rotation of the valve core. For example, the control valve 120 includes an electric reversing valve. For example, the control valve 120 includes an electromagnetic reversing valve.

For example, the liquid injection pump 110 serves as a power pump. The liquid injection pump 110 can also be referred to as an auxiliary pump, and the operation pump 220 can also be referred to as a main pump or an oil-well pump. For example, the liquid injection pump 110 includes a plunger pump, but is not limited thereto. For example, the operation pump 220 includes a rod-less pump, but is not limited thereto. For example, the operation pump 220 includes a piston pump, but is not limited thereto. Under the condition that the operation pump 220 adopts a rod-less pump, the heavy oil lifting device has a simple structure, is associated with convenient maintenance and stable operation, avoids reciprocating actions. It includes a sucker rod from the wellhead to the downhole pump head, which reduces the damage caused by mechanical wear to the device itself and eliminates the eccentric wear phenomenon. Such heavy oil lifting device thus has wider applicability and is suitable for sand wells, ultra-deep wells, horizontal wells, inclined wells and compound wells. For another example, the operation pump may include pistons that can reciprocate upwards and downwards, and the structural forms of the operation pumps are different, so pumps with other structures can also be selected.

According to the heavy oil lifting device provided by the embodiment of the present disclosure, the spent liquid after the hydraulic system is mixed with the well liquid in the pump chamber, so that the liquid amount in the wellbore is 2-3 times of the liquid amount in conventional oil recovery. Therefore, the flow velocity in the wellbore is fast, and sands can be effectively carried to the ground, so as to reduce or avoid sand plugging phenomenon.

The performance of screw pump-based oil recovery equipment itself is unstable, and problems such as rod lag and rod break frequently occur, which brings potential dangers to continuous and stable operation. Hydraulic pumps and other equipment have low production efficiency and high requirements for both operating pressure and tubing performance, and are thereby associated with potential dangers for operation. The heavy oil lifting device provided by the embodiment of the present disclosure is suitable for the exploitation of horizontal wells and composite wells, and can greatly improve the recovery ratio of heavy oil.

The heavy oil lifting device provided by the embodiment of the present disclosure has stable performance and can operate continuously. Conventional heavy oil recovery equipment has poor applicability for ultra-deep wells, and the general operation depth is less than 2,000 meters due to the limitation of structure and operation mechanism. As a comparison, the heavy oil lifting device provided by the embodiment of the present disclosure uses water as the power medium, which has small pressure loss and reduced requirement for operation pressure. It can be operated at 3,000 meters underground with non-coiled tubing (conventional tubing), and can be operated at 5,000 meters underground with coiled tubing, which represents the best oil pumping and lifting recovery technology at present.

For example, as illustrated in FIG. 2 and FIG. 3, the heavy oil lifting device further includes a tubing 230. The power liquid transmission pipe 210 is located in the tubing 230, and the operation pump 220 is located in the tubing 230. The underground operation part 2 also includes the tubing 230. The tubing can be non-coiled tubing (conventional tubing) or coiled tubing. A conventional tubing is formed by connecting multiple pipelines together, with each of the pipelines having a length of 8 meters-10 meters. The length of a coiled tubing can be 5,000 meters-7,000 meters, which represents the largest depth of a heavy oil lifting operation in common technology. Thus, the length of the coiled tubing should be selected according to the operation requirements. The power liquid transmission pipe is located inside the tubing, and is configured to transmit the power liquid. Conventional tubing can meet the requirements of more than 3,000 meters underground, while the coiled tubing can meet the requirements of 5,000 meters underground. Thus, it is suitable for sand wells, ultra-deep wells, horizontal wells and compound wells, and caters to the development trend of heavy oil recovery.

For example, the center of the power liquid transmission pipe 210 can coincide with the center of the tubing 230. In this case, the power liquid transmission pipe 210 can be referred to as a center pipe.

For example, the power liquid drives the operation pump 220 to reciprocate to form spent liquid, the spent liquid is mixed with well liquid to form oil-containing mixed liquid, and the operation pump 220 is configured to lift the oil-containing mixed liquid to the ground through the tubing 230.

As illustrated in FIG. 2, one end of the power liquid transmission pipe 210 is connected with the control valve 120, and the other end of the power liquid transmission pipe 210 is connected with the operation pump 220. The liquid after pressurization passes through the power liquid transmission pipe 210 to reach the operation pump 220, and is used as the power liquid of the operation pump 220 to drive the operation pump 220 to reciprocate in the tubing 230, so as to pump well liquid containing heavy oil. The liquid, after passing through the pump chamber, becomes spent liquid and is mixed with well liquid so as to become oil-containing mixed liquid, and the operation pump 220 reciprocates to lift the mixed liquid to the ground. FIG. 2 illustrates the ground 400.

Because the spent liquid is mixed with well liquid, the viscosity of heavy oil is reduced, which is beneficial to the heavy oil lifting. The mechanical system for lifting crude oil and the viscosity reduction system are combined into a single system, which can greatly reduce the lifting cost. The lifting device has a simple structure, the hydraulic station is built on the ground, the water is used as the working medium, and the liquid injection pump that provides high-pressure liquid pressurizes the water separated from the separator and injects it into the underground through the power liquid transmission pipe so as to provide power for the operation pump. According to different input parameters, the control component can automatically judge/determine and select the liquid injection pump for operation. Compared with the conventional heavy oil lifting method, the production cost is greatly reduced. The medium of the power liquid can also be water added with emulsion, or can be oil.

The heavy oil lifting device provided by the embodiment of the present disclosure can replace the solutions such as electric heating, thin oil mixing and chemical viscosity reduction, so as to realize heavy oil recovery through the operation mechanism of the device without the need of additional heavy oil viscosity reduction measures. It can save 240,000 yuan of electricity cost per year as compared with the case of electric heating. It can save the cost for adding thin oil as compared with the case of thin oil mixing. Depending on different well conditions, the proportion of thin oil as mixed is more than 30%, even more than 100% in some Oilfield, and the cost as saved reaches 300,000 yuan-800,000 yuan per year. It can save the cost of chemical agents as compared with the case of chemical viscosity reduction.

According to the heavy oil lifting device provided by the embodiment of the present disclosure, the lifting mechanical system and the lifting viscosity reduction system are combined into a single system, which can greatly reduce the lifting cost. The hydraulic station is built on the ground. The water is used as power liquid, which is pressurized by a liquid injection pump and injected into the underground through a power liquid transmission pipe to provide power for the operation pump so as to drive the piston to reciprocate. The well liquid is pumped into the pump chamber to be mixed with the power liquid, so as to increase the water content of heavy oil, and at the same time increase lubrication and oil lifting production. The produced well liquid flows into the metering station, and the water separated by oil-water separation equipment can be recycled and reused as power liquid for injection operation.

The operation pump of the heavy oil lifting device provided by the embodiment of the present disclosure converts hydraulic energy into mechanical energy under the action of power liquid and enables up-and-down reciprocating motion, and the well liquid is pumped into the pump chamber to be mixed with the power liquid so that the water content of the heavy oil in the wellbore is improved to higher than 70%. In this way, the produced liquid is lifted to the ground in the form of oil-in-water, so as to realize heavy oil recovery. The produced well liquid flows into the metering station.

Principles of heavy oil lifting technology lies in that: water is used as power liquid to drive the operation pump to operate, while spent liquid is mixed with well liquid to increase the water content of heavy oil, so that crude oil is lifted and produced in the form of oil-in-water. The power liquid is not limited to water, but emulsion or chemical agent can be added into water, or water can be replaced with other suitable liquids as power liquid.

For example, as illustrated in FIG. 2, the heavy oil lifting device further includes a first transmission pipeline 161, the first transmission pipeline 161 is connected with the liquid inlets 110*a* of the plurality of liquid injection pumps 110 and is configured to transmit liquid.

For example, as illustrated in FIG. 2, the heavy oil lifting device further includes a filter 140. The filter 140 is arranged in the first transmission pipeline 161 and is configured to filter the liquid passing through the filter 140. The filter 140 is used for filtering the liquid passing through the filter, which is beneficial to obtain clean power liquid.

For example, as illustrated in FIG. 2, the heavy oil lifting device further includes a second transmission pipeline 162, and the liquid outlets 110*b* of the plurality of liquid injection pumps 110 are connected with the power liquid transmission pipe 210 through the second transmission pipeline 162.

For example, as illustrated in FIG. 2, the heavy oil lifting device further includes a flowmeter 130, the flowmeter 130 is arranged in the second transmission pipeline 162. The flowmeter is used for measuring the flow rate of injected power liquid, which is convenient for calculating the final oil production.

For example, as illustrated in FIG. 2, the heavy oil lifting device further includes a third transmission pipeline 163, the third transmission pipeline 163 is connected with the tubing 230 to transmit the oil-containing mixed liquid.

FIG. 2 illustrates water 801 and oil 802. The first transmission pipeline 161 transmits the liquid, the second transmission pipeline 162 transmits the liquid after pressurization, and the third transmission pipeline 163 transmits the oil-containing mixed liquid 800.

For example, as illustrated in FIG. 2, the heavy oil lifting device further includes a separator 150, the separator 150 is connected with the third transmission pipeline 163. The separator 150 is configured to perform oil-water separation on the oil-containing mixed liquid. The separator 150 includes an oil outlet 151 and a water outlet 152, and the water outlet 152 is connected with the first transmission pipeline 161 to form a circulation loop of power liquid. For example, the filter 140 is used for filtering the water flowing out of the separator 150, which is beneficial to obtain clean power liquid. The water separated by the oil-water separator can be recycled and injected as power liquid again, thus realizing the closed-loop operation of the whole heavy oil recovery lifting system.

The heavy oil lifting device provided by some embodiments of the present disclosure adopts the power liquid closed-loop operation mode. In the heavy oil lifting device, on one hand, water is used as power liquid, which is pressurized on the ground and pumped into the underground to drive the operation pump to move, so as to achieve the pumping effect; on the other hand, water is also used as a carrier for lifting after being mixed with heavy oil in such a manner that, water is mixed with well liquid in the pump chamber so as to lift the heavy oil in the form of oil-in-water for recovery. After recovery, the water is separated by oil-water separation and returned to the wellhead for continuous operation. The water can be recycled during the whole operation of the device, thereby realizing closed-loop operation, improving the utilization rate of water and increasing the economy.

For example, as illustrated in FIG. 2, the heavy oil lifting device further includes a heating member 171, the heating member 171 is configured to heat the liquid to form a thermal power liquid. At the same time, depending on different viscosity of heavy oil and the demands of oil recovery, the thermal power liquid can be injected optionally. By inputting operation parameters, the control member controls the temperature of the injected power liquid so as to reduce the viscosity of downhole heavy oil, thereby achieving better lifting effect.

For example, as illustrated in FIG. 3, the heavy oil lifting device further includes a casing 261, the tubing 230 is located in the casing 261. The space between the tubing 230 and the casing 261 is a casing annulus 262. FIG. 3 illustrates an oil layer 300. For example, as illustrated in FIG. 3, the casing 261 has an inlet 263. In some other embodiments, the inlet 263 can also be located at the end part of the casing 261. The well liquid or oil layer enters into the casing annulus 262 through the inlet 263. For example, the well liquid includes heavy oil.

For example, in some embodiments, as illustrated in FIG. 3, the heavy oil lifting device further includes a connector 271 and a sand settler 272, and the power liquid transmission pipe 210 is connected with the sand settler 272 through the connector 271, and the sand settler 272 is configured to reduce the amount of sands entering the tubing 230.

For example, in some embodiments, the operation pump 220 includes a sealing ring. For example, in some embodiments, the heavy oil lifting device can adopt a rigid flexible structure and a compensating sealing mode, which has excellent sand discharging performance and can reduce or avoid the phenomenon of sand plugging of the operation pump. For example, the rigid flexible structure may refer to that, the tubing is a rigid pipe, while the operation pump is a rod-less pump. For example, the piston structure in the operation pump can move freely around the piston rod and has flexibility, which can remove the sands along with the well liquid, thus reducing or avoiding the phenomenon of sand plugging. For example, the compensating sealing mode may refer to the universal plug sealing arrangement, which is compensatory and has better sealing effect.

For example, as illustrated in FIG. 4A, in some embodiments, the operation pump 220 includes a first housing 2291, a second housing 2292, and a first reversing valve 2201, a second reversing valve 2202 and a piston structure 2203 which are located in the second housing 2292. The first housing 2291 is located in the second housing 2292. For example, as illustrated in FIG. 4A, the operation pump 220 includes an opening 2211, the opening 2211 is connected with the tubing, and the oil-containing mixed liquid enters the tubing through the opening to be lifted through the tubing. For example, as illustrated in FIG. 4A, the operation pump 220 includes oil inlets 2208 and 2209, and one-way valves 2210 are respectively arranged at the oil inlet 2208 and the oil inlet 2209 to facilitate the crude oil to enter the operation pump 220. The piston structure 2203 can be referred to as a reciprocating piston, and the operation pump 220 can be referred to as a reciprocating pump.

For example, referring to FIGS. 4A to 4C, the first reversing valve 2201 includes a first valve core, the first valve core includes a first guide rod 011 and a third piston 012. The second reversing valve 2202 includes a second valve core, the second valve core includes a second guide rod 021 and a fourth piston 022. As illustrated in FIGS. 4A to 4C, the first reversing valve 2201 further includes a first piston cylinder 031. The first valve core moves in the first piston cylinder 031; and the second reversing valve 2202 further includes a second piston cylinder 032, and the second valve core moves in the second piston cylinder 032.

For example, referring to FIGS. 4A to 4C, the operation pump 220 further includes openings 2240 to 2249, liquid can enter corresponding pipelines or chambers through the openings 2240 to 2249. For example, referring to FIGS. 4A to 4C, openings 2240 to 2249 are located in the second housing 2292. For example, referring to FIGS. 4A to 4C, the operation pump 220 further includes channels 2251, 2252 and 2261, and the channels 2251, 2252 and 2261 are all configured to allow the power liquid to pass there-through.

For example, as illustrated in FIGS. 4A to 4C, the piston structure 2203 includes a piston rod 30, and a first piston 31 and a second piston 32 located at two ends of the piston rod 30, respectively. Referring to FIGS. 4A to 4C, the piston structure 2203 can rotate around the axis of the piston rod 30 to facilitate sand discharge. The heavy oil lifting device provided by some embodiments of the present disclosure can realize sand carrying production. For example, as illustrated in FIGS. 4A to 4C, the piston rod 30 is not fixed in its axial direction, and the piston rod 30 can rotate around its axial direction so as to facilitate sand discharge.

For example, as illustrated in FIGS. 4A to 4C, the operation pump 220 includes a partition member 280, the partition member 280 divides the pump chamber 22 into a first chamber 22*a* and a second chamber 22*b*. The first chamber 22*a* includes a first oil chamber 2281 and a first power liquid chamber 2271. The second chamber 22*b* includes a second power liquid chamber 2272 and a second oil chamber 2282.

For example, as illustrated in FIGS. 4A to 4C, the first piston 31 is located in the first chamber 22*a* and divides the first chamber 22*a* into a first power liquid chamber 2271 and a first oil chamber 2281. The second piston 32 is located in the second chamber 22*b* and divides the second chamber 22*b* into a second power liquid chamber 2272 and a second oil chamber 2282. The piston rod 30 passes through the partition member 280, and the piston structure 2203 can rotate around the axis of the piston rod.

For example, as illustrated in FIG. 4A, the operation pump 220 includes a pump chamber 2. The pump chamber 22 includes a first oil chamber 2281, a second oil chamber 2282, a first power liquid chamber 2271, and a second power liquid chamber 2272. The first oil chamber 2281 can also be referred to as an upper oil chamber. The second oil chamber 2282 can also be referred to as a lower oil chamber. The first power liquid chamber 2271 can also be referred to as an upper power liquid chamber, and the second power liquid chamber 2272 can also be referred to as a lower power liquid chamber.

As illustrated in FIGS. 4A to 4C, the working surface of the power liquid chamber and the working surface of the oil chamber may work on two different end surfaces of the same piston, which is more efficient. For example, for the first piston 31, the upper and lower surfaces of the first piston 31 are the working surfaces of the first power liquid chamber 2271 and the first oil chamber 2281, respectively. For example, for the second piston 32, the lower and upper surfaces of the second piston 32 are the working surfaces of the second power liquid chamber 2272 and the second oil chamber 2282, respectively.

For example, as illustrated in FIG. 4D, the pipelines of the operation pump 220 include two oil pumping pipelines (oil pumping pipelines 2231 and 2232), two reversing pipelines (reversing pipelines 2233 and 2234) and two power liquid pipelines (liquid inlet pipeline 2235, and liquid outlet pipeline 2236), totaling six pipelines. For example, the six pipelines symmetrically surround the piston structure 2203. For example, the reversing pipelines and the power liquid pipelines are all used for circulating the power liquid. For example, as illustrated in FIG. 4D, the connection line between the centers of the oil pumping pipeline 2231 and the oil pumping pipeline 2232 can pass through the center C0 of the operation pump. The connection line between the centers of the reversing pipeline 2233 and the reversing pipeline 2234 can pass through the center C0 of the operation pump. The connection line between the centers of the liquid inlet pipeline 2235 and the liquid outlet pipeline 2236 can pass through the center C0 of the operation pump. For example, as illustrated in FIG. 4D, the reversing pipeline 2233 and the liquid outlet pipeline 2236 are located on one side of the connection line between the centers of the oil pumping pipeline 2231 and the oil pumping pipeline 2232. The reversing pipeline 2234 and the liquid inlet pipeline 2235 are located on the other side of the connection line between the centers of the oil pumping pipeline 2231 and the oil pumping pipeline 2232, so as to facilitate the circulation of power liquid (reversing liquid).

For example, as illustrated in FIG. 4A, the opening 2241 communicates with the oil pumping pipeline 2231, and the opening 2242 communicates with the oil pumping pipeline 2232. For example, as illustrated in FIG. 4B, the reversing liquid can pass through openings 2244 and 2245, and the power liquid can pass through openings 2243 and 2246. Both the opening 2243 and the opening 2245 communicate with the reversing pipeline 2234, and both the opening 2244 and the opening 2246 communicate with the reversing pipeline 2233. For example, as illustrated in FIG. 4C, both the opening 2249 and the opening 2247 communicate with the liquid inlet pipeline 2235, and both the opening 2248 and the opening 2240 communicate with the liquid outlet pipeline 2236. For example, as illustrated in FIG. 4C, the power liquid in the liquid inlet pipeline 2235 can enter the pump chamber through the opening 2247; the spent liquid can enter the liquid outlet pipeline 2236 through the opening 2248; the power liquid in the liquid inlet pipeline 2235 can enter the pump chamber through the opening 2249; and the spent liquid can enter the liquid outlet pipeline 2236 through opening 2240.

Hereinafter, the operation process of the operation pump is described with reference to FIG. 2 and FIGS. 4A to 4C. As illustrated in FIG. 2, the power liquid is pressurized by the liquid injection pump 110 on the ground and enters the operation pump 220 through the power liquid transmission pipe 210. Referring to FIG. 4A to FIG. 4C, the power liquid enters the first power liquid chamber 2271 through the power liquid pipeline (liquid inlet pipeline 2235), and drives the piston structure 2203 to move downwards. At this time, the second oil chamber 2282 realizes a suction force and the first oil chamber 2281 realizes a thrust force. The well liquid is sucked into the second oil chamber 2282 through the oil pumping pipeline 2231, and the well liquid in the first oil chamber 2281 is pushed out to the oil pumping pipeline 2232. At this time, the power liquid (spent liquid) in the second power liquid chamber 2272 is pushed out to the reversing pipeline 2233 and the liquid outlet pipeline 2236, and the spent liquid and the well liquid in the oil pumping pipeline 2232 are mixed as oil-containing mixed liquid at the opening 2211. After the piston structure 2203 moves to the lowest end, the power liquid is transmitted through the reversing pipeline to realize the reversing movement of the piston structure 2203. The power liquid enters the second power liquid chamber 2272 to drive the piston structure 2203 to move upwards, and the second oil chamber 2282 realizes a thrust force to push out the well liquid in the second oil chamber 2282 to be mixed with the power liquid (spent liquid) in the power liquid pipeline (liquid outlet pipeline 2236) through the oil pumping pipeline 2231. At this time, the first oil chamber 2281 realizes a suction force to suck the well liquid into the first oil chamber 2281, and the oil-containing mixed liquid is lifted to the ground through the tubing. Then a next cycle is performed, and the crude oil is continuously lifted over and over again.

For example, an oil outlet one-way valve can be provided in the oil pumping pipeline 2231, and an oil outlet one-way valve can be provided in the oil pumping pipeline 2232.

For example, when the piston structure 2203 moves downward, one of the oil pumping pipelines 2231 and 2232 is used as an oil inlet pipeline and the other one is used as an oil outlet pipeline. For example, when the piston structure 2203 moves upward, one of the oil pumping pipelines 2231 and 2232 is used as an oil inlet pipeline and the other one is used as an oil outlet pipeline.

For example, as illustrated in FIGS. 4A to 4C, the first reversing valve 2201 is configured to push the piston structure 2203 to move downward under the action of the reversing liquid/power liquid. When the piston structure 2203 moves downward, it drives the second reversing valve 2202 to move from top to bottom. The second reversing valve 2202 is configured to push the piston structure 2203 to move upward under the action of the reversing liquid/power liquid. When the piston structure 2203 moves upward, it drives the first reversing valve 2201 to move from bottom to top. The first reversing valve 2201 reciprocates in an up-and-down direction, and the second reversing valve 2202 reciprocates in an up-and-down direction. For example, the first reversing valve 2201 moves from top to bottom under the action of the power liquid, so that the piston structure moves from top to bottom; while the second reversing valve 2202 moves from bottom to top under the action of the power liquid, so that the piston structure moves from bottom to top.

For example, the piston structure 2203 moves between a top dead center (TDC) and a bottom dead center (BDC). When the piston structure 2203 is located at the top dead center, the first valve core of the first reversing valve 2201 is located at the top dead center, and the opening 2245 communicates with the opening 2247; and the second valve core of the second reversing valve 2201 is located at the top dead center, and the opening 2244 communicates with the opening 2240.

The operation pump 220 illustrated in FIG. 4A to FIG. 4C can suck oil into the pump chamber 22 in both of the case where the piston structure 2203 moves downward and the case where the piston structure 2203 moves upward, which is beneficial to improve the oil pumping efficiency. The embodiments of the present disclosure do not limit the structure of the operation pump 220, as long as it can pump and lift the crude oil.

At least one embodiment of the present disclosure further provides a heavy oil lifting method, which includes the following steps.

Step S11, sucking liquid by a liquid injection pump 110, and pressurizing and discharging the liquid.

Step S12, taking the liquid after pressurization as power liquid.

Step S13, driving the power liquid to pass through a power liquid transmission pipe 210 so as to drive an operation pump 220 to reciprocate.

Step S14, converting the power liquid into spent liquid and mixing the spent liquid with well liquid in a pump chamber of the operation pump 220 so as to form an oil-containing mixed liquid.

Step S15, driving the operation pump 220 to reciprocate so that the oil-containing mixed liquid is lifted to ground, in which a plurality of liquid injection pumps 110 is arranged, and each of the plurality of liquid injection pumps 110 includes a liquid inlet 110*a* and a liquid outlet 110*b*, and the liquid outlets 110*b* of the plurality of liquid injection pumps 110 are connected with the control valve 120. The method further includes: adjusting the control valve 120 to be in switchable communication with one of the plurality of liquid injection pumps 110 so that the power liquid transmission pipe 210 is in switchable communication with one of the plurality of liquid injection pumps 110.

For example, identifying an operation parameter to match a proper liquid injection pump, and reversing the control valve to allow the liquid outlet of the matched liquid injection pump to communicate with the power liquid transmission pipe, so that the power liquid is injected into the operation pump through the power liquid transmission pipe.

For example, the plurality of liquid injection pumps 110 include at least two liquid injection pumps 110 with different powers, and the method further includes: selecting a liquid injection pump 110 with suitable power for operation according to the operation parameter.

During the whole process of heavy oil recovery, the oil production exhibits a decrease. In order to maintain the oil production, it is desired to provide different operating powers at different stages of the heavy oil recovery. In addition, because the ground conditions vary depending on the heavy oil fields, lifting devices with different operating powers should be adopted in different areas, which leads to poor universality of lifting devices. The hydraulic station of the system on the ground adopts a plurality of liquid injection pumps of different model numbers, so that the heavy oil lifting device and method provided by the embodiments of the present disclosure can switch among different liquid injection pumps according to different operation periods and different ground conditions, thereby improving the applicability and operation durability of the whole device.

For example, in case of different operating parameters, the liquid injection pump 110 with the power corresponding to the concerned operating parameter can be selected for operation, which is beneficial to heavy oil recovery. For example, in the initial stage of oil recovery, the liquid injection pump 110 with the first power is used; and with the progress of oil recovery, the liquid injection pump 110 with the second power is used; and the first power is less than the second power, without limiting the embodiments of the present disclosure thereto.

For example, the heavy oil lifting method further includes: performing oil-water separation on the oil-containing mixed liquid lifted to the ground, and sucking the separated water into the liquid injection pump 110 to be used as liquid (sucked liquid), so as to form a circulation loop of the power liquid, thereby improving the utilization rate of water and increase the economy. For example, in the whole lifting device, on one hand, water is used as power liquid, which is pressurized on the ground and pumped into the underground to drive the operation pump to move so as to achieve the pumping effect; on the other hand, water is also used as a carrier for lifting after being mixed with heavy oil in such a manner that, the water is mixed with the well liquid in the pump chamber so as to lift the heavy oil in the form of oil-in-water. After recovery, the water is separated by oil-water separation, and the separated water returns to the wellhead for continuous operation. The water can be recycled to realize closed-loop operation.

For example, the heavy oil lifting method further includes: heating the power liquid to form a thermal power liquid. Referring to FIG. 2, a heating member can be used to heat the power liquid.

Figure 6:
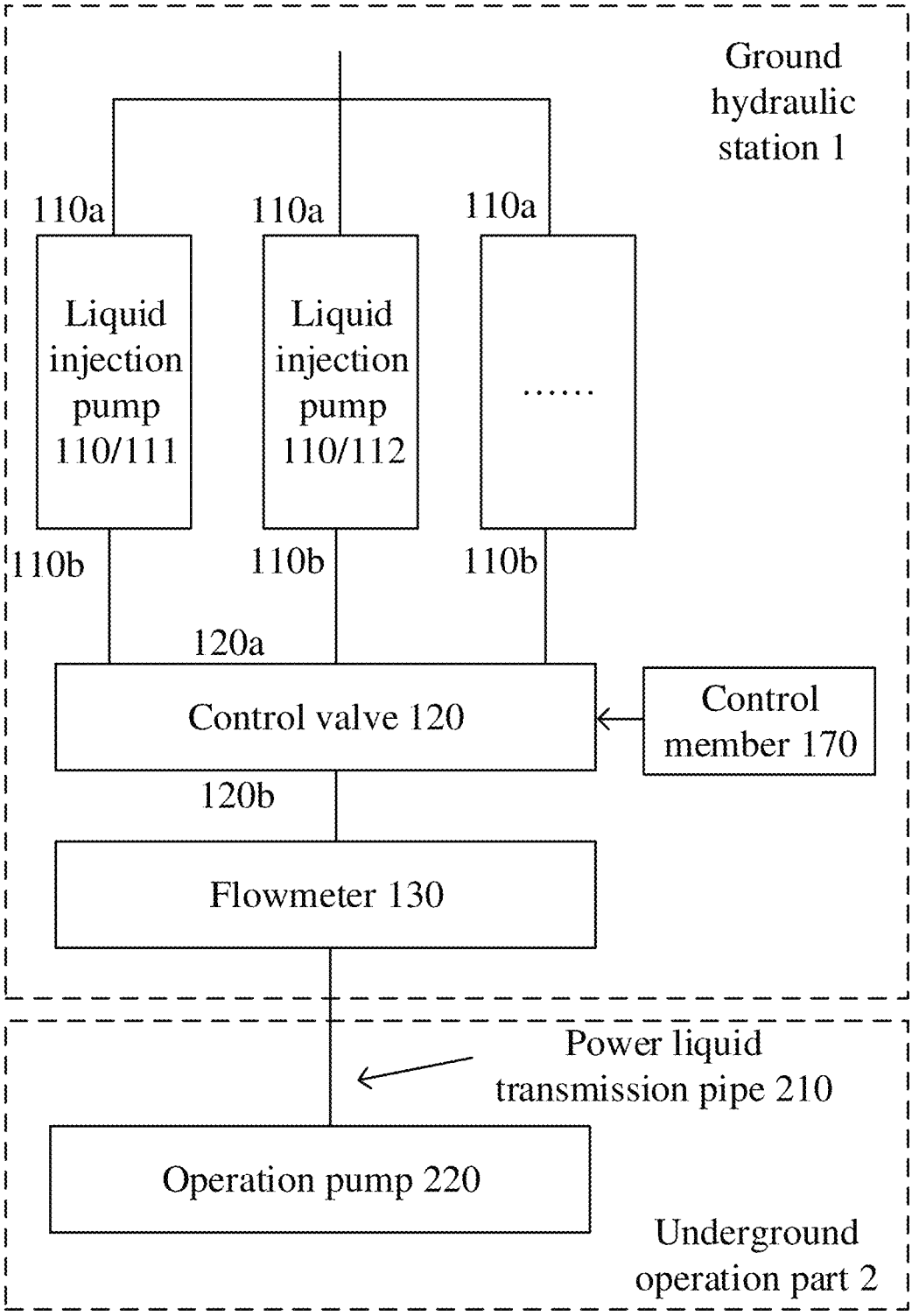
FIG. 6 is a schematic diagram of an example heavy oil lifting device provided by an embodiment of the present disclosure.
Figure 7:
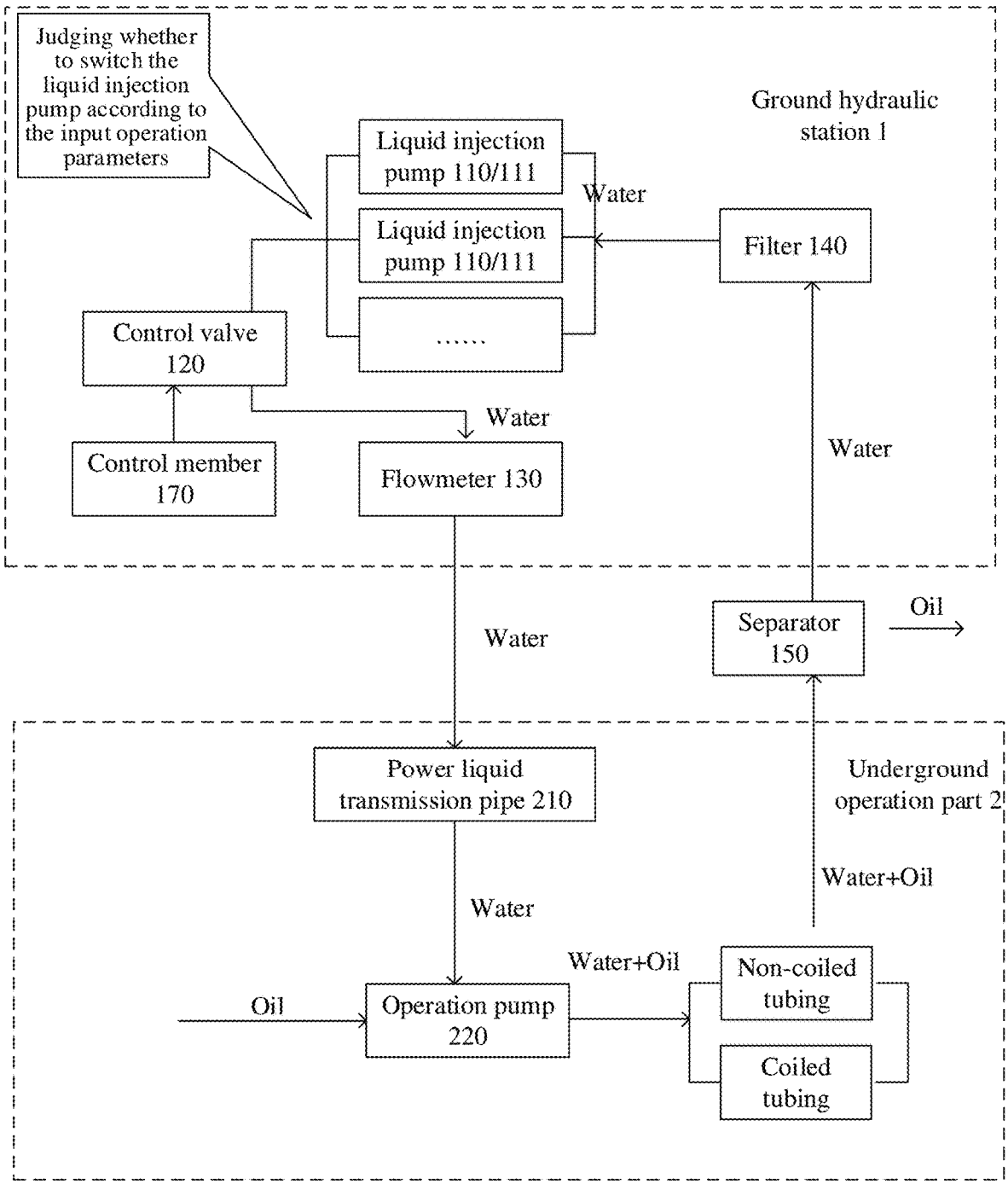
FIG. 7 is a schematic diagram of an example heavy oil lifting device or method provided by an embodiment of the present disclosure.

FIG. 6 is a schematic diagram of a heavy oil lifting device provided by an embodiment of the present disclosure. FIG. 7 is a schematic diagram of a heavy oil lifting device or method provided by an embodiment of the present disclosure.

For example, as illustrated in FIGS. 6 and 7, the heavy oil lifting device further includes a control member 170. The control member 170 is connected with the control valve 120 and is configured to control the control valve 120 to communicate with one of the plurality of liquid injection pumps 110. The heavy oil lifting device and method provided by some embodiments of the present disclosure are intelligent heavy oil lifting devices and methods, so as to realize intelligent exploitation.

Usually, heavy oil recovery systems need to be debugged manually, and require for manage and maintain regularly by special personnel during later operation, which brings a great burden to management costs An intelligent recovery method may be desired, which can reduce personnel operations, realize unmanned operation and reduce operation risks. The intelligent heavy oil lifting system mainly includes the following intelligent modes.

I. The detector provides important operation information such as viscosity of heavy oil, composition of heavy oil, well depth and temperature, etc., as operation input parameters. The control system selects appropriate output power, power liquid displacement and operation pressure according to the operation input parameters, and changes the system and the operation parameters according to the ground conditions, so as to ensure the optimal operation scheme.

II. Heating pipes are arranged on the ground, and the system automatically judges whether to provide thermal power liquid according to the viscosity of heavy oil and the production demand, thereby reducing viscosity of heavy oil and improving recovery efficiency of heavy oil. (Usually, the double-acting rod-less oil recovery equipment has no heating system and no thermal power liquid option).

III. The hydraulic station is equipped with monitoring components (for example, monitoring cameras), which can realize remote control and real-time display of operation parameters, realize unmanned management and reduce operating costs. Once the operation parameters are abnormal, the system gives an alarm and suspends the operation, which can effectively ensure the operation safety.

Some embodiments of the present disclosure provide an intelligent heavy oil lifting method, including the following steps.

Step S21, starting the device to obtain operation parameters. For example, the detector provides operation information such as viscosity of heavy oil, composition of heavy oil, well depth and temperature as operation parameters, and the operation parameters can further include oil production, operation pressure, injected amount of power liquid, etc.

Step S22, starting the operation, automatically selecting the power of the liquid injection pump according to the operation parameters as provided, judging whether to provide thermal power liquid and starting the device, injecting the power liquid stably, displaying the information of power liquid flow, working pressure, operation pump temperature, stroke number, well liquid output and the like on a control panel in real time and starting a monitoring member at the same time to monitor the abnormal situation of the operation parameters in the whole process, which is beneficial to the operation safety.

Step S23: injecting the power liquid into the operation pump through the power liquid transmission pipe to provide power for the operation pump, and converting the hydraulic energy into mechanical energy to drive the piston structure to move so as to realize pumping of the pump chamber. The piston structure can adopt the form of a single piston or include a plurality of pistons to realize simultaneous operation of a plurality of pump chambers, thus increasing the mixing amount of well liquid and spent liquid (the inputted power liquid) and improving the oil recovery efficiency.

Step S24: sucking the well liquid into the pump chamber and mixing the well liquid with the spent liquid to increase the water content of heavy oil and form a mixed liquid.

Step S25: lifting the oil-containing mixed liquid, in the form of oil-in-water for lubrication, to the wellhead through the tubing.

Step S26: flowing the oil-containing mixed liquid produced at the wellhead into a comprehensive treatment station along the ground pipeline for oil-water separation by the separator.

Step S27: recycling the separated water as power liquid after filtration, thereby saving water resources and forming closed-loop operation of the system.

The heavy oil lifting device provided by embodiments of the present disclosure can further include one or more processors and one or more memories. The processor can process data signals, and can include various computing structures, such as a complex instruction set computer (CISC) structure, a reduced instruction set computer (RISC) structure, or a structure that implements a plurality of instruction set combinations. The memory can store instructions and/or data executed by the processor. These instructions and/or data can include codes for implementing some or all of the functions of one or more devices described in the embodiments of the present application. For example, the memory includes dynamic random access memory (DRAM), static random access memory (SRAM), flash memory, optical memory, or other memories well known to those skilled in the art.

In some embodiments of the present application, the control member 170 includes codes and programs stored in a memory; the processor can execute the code and program to realize some or all of the functions of the control member 170 as described above.

In some embodiments of the present disclosure, the control member 170 can be a special hardware device for realizing some or all of the functions of the control member 170 as described above. For example, the control member 170 can be a circuit board or a combination of a plurality of circuit boards for realizing the functions described above. In an embodiment of the present application, the combination of one circuit board or a plurality of circuit boards can include: i), one or more processors; ii), one or more non-transitory computer-readable memories connected to the processor; and iii), a firmware stored in the memory executable by the processor.

Without conflict, features in the same embodiment and different embodiments of the present disclosure can be combined with each other.

The above are merely specific embodiments of the present disclosure, and the scope of protection of the present disclosure are not limited thereto. Any modifications or substitutions that can be easily made by those skilled who are familiar with the prior art without departing from the technical scope revealed in the present disclosure belong to the scope of protection sought to be protected by the present disclosure. Therefore, the scope of protection of the present disclosure should be defined by the appended claims.

The invention claimed is:

1. An oil lifting device, comprising:

a plurality of liquid injection pumps, each of the plurality of liquid injection pumps comprising a liquid inlet and a liquid outlet, and each of the plurality of liquid injection pumps being configured to intake a liquid and discharge the liquid after pressurization;

a control valve, comprising a first end and a second end, the liquid outlets of the plurality of liquid injection pumps for discharging the liquid after pressurization being connected with the first end of the control valve;

a power liquid transmission pipe, connected with the second end of the control valve and configured to transmit the liquid after pressurization via the control valve; and an operation pump, connected with the power liquid transmission pipe, and the liquid after pressurization being used as a power liquid to drive the operation pump to reciprocate, wherein the control valve is configured to be switchably communicated with one of the plurality of liquid injection pumps so that the power liquid transmission pipe is switchably communicated with one of the plurality of liquid injection pumps.

2. The oil lifting device according to claim 1, wherein the plurality of liquid injection pumps comprise at least two liquid injection pumps with different powers.

3. The oil lifting device according to claim 1, further comprising a tubing, wherein the power liquid transmission pipe is disposed in the tubing, and the operation pump is disposed in the tubing.

4. The oil lifting device according to claim 3, wherein:

the power liquid drives the operation pump to reciprocate and then forms a spent liquid, and the spent liquid is mixed with well liquid to form an oil-containing mixed liquid; and the operation pump is configured to lift the oil-containing mixed liquid to ground through the tubing.

5. The oil lifting device according to claim 4, further comprising a first transmission pipeline, wherein:

the first transmission pipeline is connected with the liquid inlets of the plurality of liquid injection pumps; and the first transmission pipeline is configured to transmit the liquid.

6. The oil lifting device according to claim 5, further comprising a filter, wherein the filter is arranged in the first transmission pipeline and configured to filter the liquid passing therethrough.

7. The oil lifting device according to claim 5, further comprising a second transmission pipeline, wherein the liquid outlets of the plurality of liquid injection pumps are connected with the power liquid transmission pipe through the second transmission pipeline.

8. The oil lifting device according to claim 7, further comprising a flowmeter, wherein the flowmeter is arranged in the second transmission pipeline.

9. The oil lifting device according to claim 8, further comprising a third transmission pipeline, wherein the third transmission pipeline connects the tubing to transmit the oil-containing mixed liquid.

10. The oil lifting device according to claim 9, further comprising a separator, wherein:

the separator is connected with the third transmission pipeline, the separator is configured to perform oil-water separation on the oil-containing mixed liquid;

the separator comprises an oil outlet and a water outlet; and the water outlet is connected with the first transmission pipeline to form a circulation loop of the power liquid.

11. The oil lifting device according to claim 1, further comprising a heating member, wherein the heating member is configured to heat the liquid to form thermal power liquid.

12. The oil lifting device according to claim 3, further comprising a casing, wherein the tubing is located in the casing.

13. The oil lifting device according to claim 1, further comprising a control member, wherein the control member is connected with the control valve so as to be configured to control the control valve to communicate with one of the plurality of liquid injection pumps.

14. The oil lifting device according to claim 1, wherein:

the operation pump comprises a housing, a piston structure and a partition member;

the partition member divides the housing into a first chamber and a second chamber;

the piston structure comprises a piston rod, a first piston and a second piston;

the first piston and the second piston are respectively arranged at two ends of the piston rod;

the first piston is located in the first chamber and divides the first chamber into a first power liquid chamber and a first oil chamber; and the second piston is located in the second chamber and divides the second chamber into a second power liquid chamber and a second oil chamber;

the piston rod passes through the partition member; and the piston structure can rotate around an axis of the piston rod.

15. An oil lifting method, comprising:

intaking in a liquid by a liquid injection pump, and pressurizing and discharging the liquid;

taking the liquid after pressurization as a power liquid;

passing through a power liquid transmission pipe to drive an operation pump to perform a reciprocating motion;

mixing spent liquid generated from the power liquid with well liquid in a pump chamber of the operation pump to form an oil-containing mixed liquid; and switchably lifting the oil-containing mixed liquid to ground through the reciprocating motion of the operation pump, wherein a plurality of liquid injection pumps is disposed, each comprising a liquid inlet and a liquid outlet, the liquid outlets of the plurality of liquid injection pumps for outputting pressurized liquid from the plurality of liquid injection pumps are connected with a control valve, and wherein the method further comprises:

adjusting the control valve to be in a switchable communication with one of the plurality of liquid injection pumps so that the power liquid transmission pipe is in switchable communication with one of the plurality of liquid injection pumps to receive the pressurized liquid from the plurality of liquid injection pumps via the control valve.

16. The oil lifting method according to claim 15, wherein the plurality of liquid injection pumps comprise at least two liquid injection pumps with different powers, and the method further comprises: selecting a liquid injection pump with a suitable power for operation according to an operation parameter.

17. The oil lifting method according to claim 15, further comprising: performing oil-water separation on the oil-containing mixed liquid lifted to the ground, wherein separated water is intaken into the liquid injection pump to be used as the liquid, so as to form a circulation loop of the power liquid.

18. The oil lifting method according to claim 15, further comprising heating the power liquid to form a thermal power liquid.

19. The oil lifting method according to claim 15, further comprising a first transmission pipeline, wherein the first transmission pipeline is connected with the liquid inlets of the plurality of liquid injection pumps, and the first transmission pipeline is configured to transmit the liquid.

20. The oil lifting method according to claim 19, further comprising a second transmission pipeline, wherein the liquid outlets of the plurality of liquid injection pumps are connected with the power liquid transmission pipe through the second transmission pipeline.

* * * * *